US005478414A

United States Patent [19]

Mozelewski et al.

[11] Patent Number: 5,478,414

[45] Date of Patent: Dec. 26, 1995

[54] REFLECTIVE ALUMINUM STRIP, PROTECTED WITH FLUOROPOLYMER COATING AND A LAMINATE OF THE STRIP WITH A THERMOPLASTIC POLYMER

[75] Inventors: Frank A. Mozelewski, Lower Burrell; Daniel L. Serafin, Wexford; Robert E. Bombalski, Brackenridge, all of Pa.

[73] Assignee: Aluminum Company of America, Pittsburgh, Pa.

[21] Appl. No.: 184,311

[22] Filed: Jan. 21, 1994

Related U.S. Application Data

[63] Continuation-in-part of Ser. No. 830,021, Jan. 31, 1992, Pat. No. 5,290,424.

[51] Int. Cl.[6] ..... C25D 7/08; C25D 11/08; C23C 22/37

[52] U.S. Cl. ..... 148/265; 156/325

[58] Field of Search ..... 148/265; 156/325

[56] References Cited

U.S. PATENT DOCUMENTS

| | | | |
|---|---|---|---|
| 2,721,835 | 10/1955 | Axtell . | |
| 2,811,471 | 10/1957 | Homeyer | 148/265 |
| 2,927,874 | 3/1960 | Pimbley | 148/265 |
| 3,542,605 | 11/1970 | Harvey | 148/265 |
| 3,907,610 | 9/1975 | Yamagishi | 148/265 |
| 3,915,811 | 10/1975 | Tremmel et al. . | |
| 3,945,899 | 3/1976 | Nikaido et al. . | |
| 3,989,876 | 11/1976 | Moji et al. . | |
| 4,003,760 | 1/1977 | Labenski | 148/265 |
| 4,025,681 | 5/1977 | Donnelly et al. . | |
| 4,085,012 | 4/1978 | Marceau et al. . | |
| 4,131,489 | 12/1978 | Newhard, Jr. . | |
| 4,183,772 | 1/1980 | Davis . | |
| 4,298,440 | 11/1981 | Hood . | |
| 4,314,004 | 2/1982 | Stoneberg . | |
| 4,331,479 | 5/1982 | Toyama . | |
| 4,345,057 | 8/1982 | Yamabe et al. . | |
| 4,400,487 | 8/1983 | Stoneberg et al. . | |
| 4,483,750 | 11/1984 | Powers . | |
| 4,490,184 | 12/1984 | Forcht et al. . | |
| 4,531,978 | 7/1985 | Otrhalek et al. . | |
| 4,601,796 | 7/1986 | Powers et al. . | |
| 4,624,752 | 11/1986 | Arrowsmith et al. . | |
| 4,654,238 | 3/1987 | Yamazaki et al. . | |
| 4,681,668 | 7/1987 | Davies et al. . | |
| 4,737,246 | 4/1988 | Powers et al. . | |
| 4,929,319 | 5/1990 | Dinter et al. . | |
| 5,035,940 | 7/1991 | Winton | 156/333 |
| 5,131,987 | 7/1992 | Nitowski et al. . | |

*Primary Examiner*—Sam Silverberg
*Attorney, Agent, or Firm*—David W. Brownlee

[57] ABSTRACT

A strip of gray reflective aluminum protected by a conversion coating and a light-permeable fluoropolymer coating which is non-adhesively interstitially mechanically bonded to the microscopic irregularities of the conversion coated surface. The highly reflective strip may be substituted for polished stainless steel and/or bi-metal and used under comparably aggressive conditions for a prolonged period without deleteriously affecting the initial D/I (distinctness of reflected image) of the shaped strip. The strip of arbitrary length may be shaped in rolling dies so that at least a portion of the strip has a radius of less than 10 mm without damaging or separating the fluoropolymer coating. The specific steps of the claimed process require starting with a bright-rolled clean strip which is conversion coated to carry a thin metal compound coating. After rinsing and drying, the reflective surface is coated with the fluoropolymer while maintaining at least 80% D/I. The strip can then be formed to a desired profile and treated with a corona discharge to activate its surface so as to facilitate non-adhesively bonding of a thermoplastic strip to the activated fluoropolymer surface.

8 Claims, 2 Drawing Sheets

REFLECTIVE ALUMINUM STRIP, PROTECTED WITH FLUOROPOLYMER COATING AND A LAMINATE OF THE STRIP WITH A THERMOPLASTIC POLYMER

This application is a continuation-in-part application of Ser. No. 07/830,021, filed Jan. 31, 1992, now U.S. Pat. No. 5,290,424.

BACKGROUND OF THE INVENTION

1. Field of the Invention

The present invention relates to methods for making highly reflective metal and in particular to a method of making reflective aluminum sheet and to making brightened aluminum trim for use in automobiles, trucks, boats and a variety of household and industrial appliances.

2. Description of the Related Art

Steel sheet with a silvered polymer film laminated to it, and formed to a desirable shape, has gained wide market acceptance for use in lighting fixtures where high reflectance is critical and cost is a secondary consideration, as for example, for light in hospital operating rooms. Relatively less expensive lighting fixtures are made from mild steel painted with a paint containing a white opaque powder having high total reflectance but low distinctness of (reflected) image ("D/I" for brevity). Narrow polished, bright sheets (referred to as "strips") of stainless steel and/or stainless steel clad aluminum (referred to as "bi-metal"), appropriately shaped, are also widely used for decorative trim in automobiles, trucks, boats and a variety of both household and industrial appliances because such decorative trim is eminently durable under aggressive conditions of use. The cost of stainless steel sheet has provided the impetus to replace decorative stainless steel trim with brightened aluminum trim.

The problem is that a brightened, coated and shaped reflective aluminum strip, provided with the protection afforded by any one or more of known coatings, whether inorganic or organic, or both, fails to meet numerous tests which are deemed essential if aluminum trim is to be substituted for the polished stainless steel trim.

This invention relates generally to a shaped, aluminum article having substantially minor-like characteristics, formed by continuously shaping a "strip" of fluoropolymer-coated aluminum alloy, for example, in a roll-forming die, which provides the strip with at least one "tight" radius which is less than 10 mm (0.375 inch). By "substantially mirror-like characteristics" is meant that the surface is characterized by having at least 75% and preferably at least 80% D/I. D/I is the sharpness of the reflected image as measured by the ratio of the reflectance at 0.3° from specular to the reflectance at the specular angle, that is, $$D/I=[(R_S-R_{0.3})/R_S]\times 100\%$$

$R_S$=specular reflectance; D/I=0 for a perfect diffuser; D/I=100 for a perfect mirror. Total reflectance of a surface is irrelevant in a consideration of its D/I.

It is well known that chemical treatments are used to remove soiled and oxidized aluminum surfaces, to brighten them to a specular luster, and to develop various types of protective or decorative coatings. The greatest value of a chemical treatment is as a pretreatment for applying finishes, including organic coatings and laminates, anodizing, electroplating, etc. The adhesion of these finishes, and others, depends in great measure on the type and quality of the chemical pretreatment. A chemical pretreatment may be outstanding as a preparation for paint, but inadequate as a pretreatment for another finish. The result is that, over the years, hundreds of chemical treatments and finishes have been developed to meet diverse needs. (See Aluminum Vol. III. Fabricating and Finishing, edited by Kent R. Van Horn, Chapter titled "Chemical Pretreating and Finishing" by George, D. J. et al. page 587 American Society for Metals, Metals Park, Ohio).

Faced with the problem of making a highly reflective aluminum surface, one skilled in the art typically chooses an aluminum alloy with a known propensity to acquire and retain a high specular luster after being mechanically bright-rolled in coil form. If one starts with such an alloy, it is mechanically bright-rolled to a high luster and cleaned.

Among numerous choices of highly reflective aluminum alloys is the use of one containing from 0.5–3% magnesium, from 0.2–0.5% silver, from 0.001–0.2% iron and from 0.01–0.15% silicon (see U.S. Pat. No. 3,720,508 to Brock et al, class 75/147): and an alloy consisting essentially of 0.25–1.5% Mg (see U.S. Pat. No. 4,601,796 to Powers et al, class 204/33), the balance in each case being aluminum. Because essentially pure aluminum has excellent reflectance, by far the most popular choices for aluminum alloys are those with a low content of alloying elements. Such alloys have inadequate strength for numerous applications which also require a specular reflectance greater than 45%, often greater than 60%. As might be expected, high strength aluminum alloys are not typically chosen for use in high reflectance applications. Yet these alloys of the AA 5XXX and AA 6XXX series, particularly 5657, 5252, 5182 and 6306, are the alloys of special interest for use in this invention.

It is known that the surface of such alloys may be protected by various treatments including anodic oxidation, hydrothermal treatment or conversion coatings employing solutions which may contain chromic acid, chromates, phosphoric acid, phosphates and fluorides. Anodic oxidation, for example, in a sulfuric acid bath, has been the bath of choice since more than a score of years ago (when it was disclosed in U.S. Pat. No. 3,530,048 to Darrow class 204/58). A thinner and more compact coating was provided by the addition of a hydrophilic colloid to the surface during the anodizing step (see U.S. Pat. No. 3,671,333 to Mosier class 204/58). A sulfuric acid anodized coating was favored for a highly reflective coating as recently as five years ago (U.S. Pat. No. 4,601,796 to Powers et al class 204/33).

It is also known to provide as thin a coating as would provide protection without vitiating the specularity of the surface. However, thin oxide coatings of the prior art, no matter how produced on a highly reflective aluminum surface, are far too thick to withstand being sharply bent without "crazing", may provide adequate protection for a short time, but may not provide enough "texture" (familiarly referred to as "grab") to anchor a protective organic coating having excellent durability and optical properties. Further, a thin coating may craze when the strip of aluminum is bent over a 2.5 cm radius mandrel; an anodized coating not quite thin enough will also craze when bent to simulate a forming operation.

In the past, an electrolytic processing step in a phosphoric acid bath, after anodizing in a sulfuric acid bath, was used to provide a surface which was then electrocolored (see U.S. Pat. No. 4,022,671 to Asada class 204/42). But conversion coatings generally have a relatively low D/I because they tend to color the surface. Further, conversion coatings have typically provided less than satisfactory bond, for our purpose, with even the most preferred matrix fluoropolymer.

Another coating on aluminum which was produced with phosphoric acid anodizing followed by AC electrocoloring resulted in a surface with excellent optical properties, as disclosed in French Demande No. 2,360,051 to Showa Aluminum K.K. The process is carried out under constant current conditions of 1 to 1.5 amps/square decimeter. There is no indication as to how bright the sheet is after it is chemically cleaned, nor what the effects of the anodizing and coloring were. There is no indication whether any organic coating would adhere satisfactorily to the surface, least of all a fluoropolymer containing at least 40 mol % of fluoroolefin units, known to produce a cured film of matrix fluoropolymer most difficult to adhere to a smooth metal surface (see U.S. Pat. No. 4,070,525).

U.S. patent application 07/830,021, filed Jan. 31, 1992, discloses and claims a method for forming a reflective strip of aluminum by cleaning the surface to remove superficial contaminants, chemically or electrochemically brightening the cleaned surface, and anodizing the brightened surface. That application further discloses coating the anodized surface with a fluoropolymer to interstitially mechanically bond the fluoropolymer to the anodized surface. The fluoropolymer surface may be treated with corona discharge and a strip of thermoplastic polymer adhesively bonded to the treated surface.

A method is desired for producing reflective strip of aluminum having at least 80% D/I and which can be shaped into a profile having at least one small radius but which is less expensive to produce than is the strip of U.S. patent application 07/830,021.

SUMMARY OF THE INVENTION

Decorative trim can be produced from bright rolled aluminum strip having substantially mirror-like characteristics, if it is first conversion coated, then coated with a light-permeable matrix fluoropolymer coating less than 1 mil thick, which is preferably solution-deposited and cured. At least a portion of the strip may be shaped around a mandrel having a radius less than 10 mm, and the coated strip aged, without debonding the matrix fluoropolymer from the oxide coating at their interface. A strip, so shaped, is characterized by maintaining a D/I of at least 80%, and essentially no loss of adhesion, measured by a Half-T Bend test, and often, a Zero-T Bend test.

The term "strip" is used herein to specify a relatively narrow and thin sheet of aluminum reflector alloy in the range from about 1 cm to 1 meter wide, preferably from 2 cm to 30 cm wide, and from about 0.5 mm to about 5 mm thick. At least one surface of the shaped article is protected by a metal compound applied by conversion coating, and the conversion coating, in turn is coated with a cold-workable, environmentally stable, essentially light-permeable coating of a curable fluoropolymer which is preferably deposited from a solution thereof on the conversion coating. Hereafter, all references to "aluminum" describe a generally high purity aluminum alloy, which when cleaned for the purpose at hand with due attention to details of known processes, produces a substantially mirror-like surface.

The term "fluoropolymer" is used to highlight the characteristic interchain configuration of the polymer which allows it to be interstitially mechanically bonded to the conversion coated surface of the reflective aluminum strip, and also to infer that such chain configuration, upon curing of the polymer, produces a receptive substrate which, if appropriately treated, will provide a receptive surface in which an adhesive may, in turn, be bonded. Interstitial mechanical bonding is evidenced by interlocking engagement of the cured fluoropolymer with a multiplicity of crystal outcroppings which form the surface of the conversion coated structure (schematically illustrated in FIG. 1 and described in greater detail hereafter) obtained by conversion coating the surface of the reflective aluminum strip. Such interlocking engagement allows the overlaid polymer to grip the underlying conversion coated surface.

Accordingly, this invention relates to a method of coating a chemically cleaned, conversion coated strip of mirror-like aluminum alloy with an essentially transparent, durable, weather-resistant, fluoropolymer coating. By "transparent" we refer to a coating which is essentially light-permeable, that is, at least 80% permeable to visible light.

More specifically, this invention relates to the foregoing protected reflective strip of shaped aluminum which, after being shaped and thereafter being exposed to alternating cycles of ultraviolet (UV) light and 100% humid conditions (commonly referred to as QUV/UVCON) for a prolonged period (i) maintains at least a 80% D/I, and (ii) maintains adhesion of the fluoropolymer coating after the strip is bent in a "Half-T Bend test". In such a test an end portion of the strip is bent double upon the remaining portion, that is, the strip is doubly bent, referred to as a "Zero-T Bend"; the remaining portion is then bent again, first over the end portion, then bent around the small radius formed at the bend of the doubly bent portions of the strip, so that the end portion is sandwiched between the bent portions of the remaining portion (see ASTM D-3794-79). Thus, the "Half-T Bend" is a less stringent test than the "Zero-T Bend" test. The protected strip of this invention typically meets the more stringent test.

Still more specifically, this invention relates to the foregoing protected strip, which after being formed to include at least one tight radius, may be laminated to a strip of thermoplastic polymer which is adhesively secured to the exposed surface of the fluoropolymer, provided the surface of the fluoropolymer is treated with a corona (or electric) discharge which "primes" the surface sufficiently to provide interstitial bonding for the adhesive.

Accordingly, this invention also relates to a method of coextruding a strip of conversion coated and polymer-coated reflective aluminum strip and a strip of thermoplastic synthetic resin adhesively bondable thereto, forming laminated decorative trim, for example, automotive trim.

Surprisingly, when the mirror-like reflective aluminum sheet is protected by a conversion coating produced by immersing the sheet in a bath of Parker-Amchem 40145 or Betz Metchem 1904 at approximately 60°–110° F. for 10–45 seconds, a relatively thin conversion coating is produced which affords an excellent grip for the matrix fluoropolymer coating without substantially sacrificing its reflected image clarity and other optical properties, yet is able to withstand a sharp bend without crazing. By "without substantially sacrificing its reflected image clarity" we mean that the D/I measured with a Hunter Lab D-47 DORI-gon (according to ASTM-E430) is decreased by less than 10 percent, preferably less than 5%, when measured within 24 hr after an organic coating at least 0.4 mil thick is dried. By "other optical properties" we refer particularly to specular reflectance "$R_s$" from which D/I is derived, and haze, each of which may be measured by the DORI-gon instrument.

Difficult as it is to find an organic coating which does not substantially sacrifice optical properties of the article. It is more difficult to find an organic coating which has excellent weatherability, yet has sufficiently good adhesion on the highly reflective sheet, so that after the sheet is conversion coated and coated with the organic, the sheet may be shaped into products such as environmentally stable bright-finished product for decorative trim, lighting fixtures and the like, without cracking or crazing either the conversion coated surface or the organic coating, yet without substantially decreasing the sheet's optical properties.

In a specific application, a coil of the conversion and polymer-coated sheet is cut into strips to make automotive trim. Typically, both surfaces are coated with polymer, though only one surface may be coated for some applications. Coating the back side of the strip improves weatherability and also formability (acts as a lubricant). It can also minimize mottling which sometimes results from recoiling of the strip.

The coated strip is then roll-formed in progressive rolling dies, cleaned, treated with a corona discharge, and an adhesive applied. In a subsequent step, the adhesive surface is covered with an elastomeric synthetic resinous strip; or, only a portion of a polymer-coated surface may be treated, coated with adhesive and covered with the strip of resin. In a specific embodiment, only those portions of the surface which are coated with adhesive are covered with an extruded thermoplastic resinous strip.

It is therefore a general object of this invention to provide a strip of arbitrary length which may be substituted for polished stainless steel and/or bi-metal and used under comparably aggressive conditions for a prolonged period without deleteriously affecting the initial D/I of the strip, and substantially without culpable prejudice vis-a-vis polished stainless steel or bi-metal in the market place.

The steps of the process of this invention produce a shapeable, coated strip, less than 5 mm thick, of aluminum alloy having a substantially mirror-like surface, characterized by being able to meet a host of test conditions. An essential test is that the coated and shaped strip, after 2500 hr QUV/UVCON exposure set forth in a specific test, SAE J2020, necessarily maintains (i) a minimum 80% D/I (ii) and essentially no loss of adhesion.

It is therefore a general object of this invention to provide a process for making reflective strip of aluminum alloy, protected with a sequential combination of conversion coating and a cured fluoropolymer, which strip is substantially free of degradation due to environmental exposure, comprising, (a) cleaning the surface of a bright-rolled sheet of aluminum in the range from about 0.010" (inch) to about 0.050" thick with solvent, alkali or acid to remove superficial contaminants, (b) generating on said surface a porous complex chromate or chromate-phosphate compound coating in the range from 100 nm (nanometers) (0.1 μm) to 0.2 mil (5 μl) thick, preferably from 0.1 μm to 3 μm thick, and most preferably more than 200 nm (0.2 μm) but no more than 2 μm thick, by immersing the cleaned aluminum in a conversion coating both at from 70° F. to 110° F. (21.1°–43.3° C.), the conversion coating deposited within less than about 45 seconds, without etching said surface, so as to produce a conversion coated reflective surface having at least 80% D/I, (c) rinsing the conversion coated surface to remove bath chemicals, preferably with water, and drying, (d) contacting the reflective surface with a matrix fluoropolymer in an amount such that, upon curing, a cured matrix fluoropolymer is interstitially mechanically bonded to the conversion coating, so as to form a coated strip which maintains at least 80% D/I, and, (e) shaping the dual-coated strip to conform to a profile having at least one radius which is less than 10 mm without debonding the cured matrix fluoropolymer from the conversion coating at their interface.

The surface of the fluoropolymer has essentially no microscopic irregularities so that no known strip of organic thermoplastic polymer is directly sufficiently adhesively bondable to the surface of the polymer to pass the SAE J2020 test. However if the surface of the fluoropolymer of the foregoing coated substantially mirror-like strip of aluminum alloy is treated with a corona discharge, the polymer surface in turn, may be coated with an adhesive which, upon curing, is bonded to the microscopic irregularities of the treated surface. A strip of laminar the thermoplastic polymer may thereafter be cohesively bonded to the coated strip. By "cohesive bonding" we refer to a bond between the strip of vinyl polymer and matrix fluoropolymer being so strong that, in a peel test, the vinyl strip will be damaged, as evidenced by a portion of the vinyl strip adhering to the matrix fluoropolymer when the vinyl strip is torn away. In contrast, an "adhesive bond" is one in which the vinyl polymer is cleanly peeled away from the matrix fluoropolymer, or, the matrix fluoropolymer is peeled away from the conversion coated aluminum surface; in either case the adhesive bond is such that the vinyl strip is undamaged, indicating neither the bond between the adhesive and vinyl, nor that between the fluoropolymer and conversion coating, is strong enough to damage the vinyl.

It is therefore a general object of this invention to provide a process for producing a laminate of the foregoing coated aluminum strip with a laminar thermoplastic polymer, comprising, electrically treating the surface of the matrix fluoropolymer with a corona discharge sufficiently to provide a receptive surface for an adhesive, and contacting the adhesive with the laminar thermoplastic polymer under pressure for sufficient time to be cohesively bonded thereto.

It is a specific object of this invention to provide a shaped article of bright rolled aluminum alloy containing from about 0.25% to 5.0% magnesium and preferably less than 0.2% silicon, coated with a matrix fluoropolymer which is in turn coated with an adhesive and coextruded with a thin laminar strip of a vinyl polymer to form a laminated coextrudate. The laminar coextrudate is uniquely characterized by the vinyl strip being cohesively bonded to the organic coating.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

Figure 1:
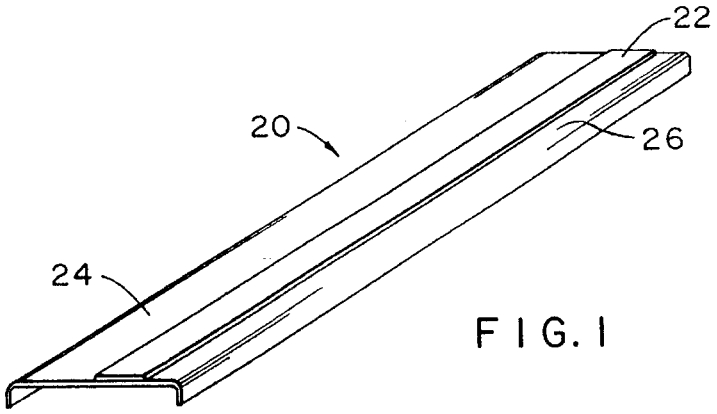
FIG. 1 is a perspective view of a section of coextruded aluminum strip of arbitrary length, one protected (far) portion of which has substantially mirror-like characteristics, and the other (near) portion of the strip is coated with a thermoplastic polymer coating which is adhesively bonded to the fluoropolymer coating.

This invention is directed to conversion coating of a bright rolled aluminum strip and to the use of a soluble fluoropolymer to provide the polymer coating which can be non-adhesively bonded to the conversion coated surface. The fluoropolymer consists essentially of at least 40 mol percent of a vinyl fluoride or vinylidene fluoride monomer which characteristically, when solidified, produces so uniformly smooth and regular a surface that, without benefit of being etched or otherwise treated to provide a receptive surface, cannot function as an adhesive to adhere two materials; nor can the fluoropolymer adhere to surfaces of commonly used metals sufficiently to withstand a peeling force of 10 lb. By "non-adhesively bonded" we refer to bonding achieved because of long fluoropolymer chains becoming interlocked with the protecting crystals on the conversion coated surface. Most preferred is a curable fluorocopolymer comprising 40 to 60 mol % of fluoroolefin units, 5 to 45 mol% of cyclohexyl vinyl ether units, 5 to 45 mol% of alkyl vinyl ether units and 3 to 15 mol % of hydroxyalkyl vinyl ether units, the polymer having an inherent viscosity of 0.05 to 2.0 dl/g in tetrahydrofuran at 30° C. Such a fluoropolymer is disclosed in U.S. Pat. No. 4,345,057 to Yamabe et al, the disclosure of which is incorporated by reference thereto as if fully set forth herein. The fluoropolymer is used without prior priming of the conversion coated surface, without a primer in the fluoropolymer, and without pigments or fillers which will denigrate the desired high D/I of the coated strip of trim. Most preferably the fluoropolymer is deposited from a solution containing from 5% to 30% by weight of fluoropolymer in methyl iso-butyl ketone (MIBK). The fluoropolymer may also be deposited from a dispersion of microscopic particles in a liquid dispersant medium, or by contacting the sheet with solid microscopic particles of the fluoropolymer, but typically, with less control than when deposited from solution.

The preferred conversion coatings for the practice of this invention are Parker-Amchem 401-45 or Betz Metchem 1904, both of which are chrome compositions which produce complex hexavalent and trivalent salts on the metal trim. The Parker-Amchem 401-45 also produces some phosphate salts. Alternatively, non-chrome conversion coatings may be used provided they provide the required bonding capability. Conversion coatings produced by the conversion coating treatment described herein have an overall thickness of the coating of about 4000Å (400 nm). The upper portion is believed to have projecting crystals which are about 1000Å (100 nm) in height and about 100Å thick. The crystals are believed to provide a profusion of peeks and valleys and a multiplicity of microscopic interstitial irregularities for gripping the fluoropolymer. Such a structure is distinguishable from an acid-etched structure which is typically deeply etched into the surface and provides irregularities which are readily distinguishable in an electron photomicrograph. The microscopic interstitial irregularities in a conversion coating produced in accordance with this invention are not distinguishable in electron photomicrographs. It was therefore unexpected that such conversion coating would provide the necessary surface for securement of a fluoropolymer coating.

In one preferred embodiment of the invention, a sheet of bright-rolled aluminum about 0.010" to about 0.040", preferably about 0.020" thick, is solvent-cleaned or washed in a detergent or acid solution, or both, then conversion coated to provide one surface with as substantially mirror-like a finish as can reasonably be achieved.

Preferred aluminum alloys are those relatively high purity aluminum alloys conventionally used in reflectorized aluminum articles. Such alloys typically contain no more than 5.0% magnesium, 0.2% iron, and 1.0% silicon. As the purity of the aluminum decreases, iron and silicon impurities, and other constituents and their reaction products collect in the oxide finish and contribute to a lower reflective surface. Most preferred for decorative automotive trim are high strength alloys, e.g. those in the 5XXX series, specifically 5252, 5552, 5152 and 5657; those in the 6XXX series, specifically 6306; and those in the 7XXX series, specifically 7029.

Though the initial bright rolling and cleaning are carried out with well known (rolling and cleaning) pretreatments, it is essential that they result in a highly polished surface having a D/I of at least 85%, more preferably at least 90%. It will be evident that the D/I of the finished polymer-coated strip will not be better than that obtained after the initial pretreatment.

The bright rolled and cleaned aluminum alloy strip is conversion coated by treating it in a bath containing coating composition such as chrome containing Parker-Amchem 401-45 or Betz Metchem 1904 at approximately 70°–110° F. for 10 to 45 seconds. For example, a bath of Amchem 401-45 may be prepared by mixing 4.4 gallons of Alodine Liquid 401 and 0.4 gallons of Alodine Liquid 45 with 100 gallons of water. The fluoride level in the bath is carefully maintained by addition of Alodine Liquid 45 as required. Other possible bath compositions and especially non-chrome systems are under development and evaluation. The conversion coating must be thin enough to minimize reduction in reflectance of the aluminum strip. The coating weight should be less than 20 mg/ft$^2$ and its thickness less than about 4000Å (400 nm).

As long as the thickness of the conversion coating is in the ranges specified hereinabove, the microscopic interstitial irregularities provide the necessary base to interlocking engagement by the fluoropolymer which is applied to the surface as a solution in a suitable, removable organic solvent. Upon removal of the solvent, the fluoropolymer forms an interstitially bonded light-permeable coating which does not significantly diminish the D/I and specularity of the polymer coated surface.

Though the process for conversion coating a substantially mirror-like aluminum sheet is conventional, it was not known that a thin conversion coating preferably less than about 4000Å (400 nm) thick, on a wide array of aluminum alloys known to produce a highly reflective surface when conventionally treated, would provide a critical thickness of a coating with upwardly extending crystals which, when coated with the fluoropolymer, does neither substantially diminish specularity nor dull the D/I of the surface below 80%, and more preferably below 90%.

This invention requires a conversion coated aluminum surface to provide purchase or "grab" for a thin layer of the matrix fluoropolymer. The fluoropolymer is the only synthetic resinous coating which will provide the desired weatherability without substantially decreasing the D/I of the surface. The aluminum sheet must have a highly reflective surface may be formed with a relatively small radius without delaminating the fluoropolymer coating. It was unexpected that a conversion coating thin enough to maintain the desired reflectance would provide sufficient grab to enable mechanical bonding of the fluoropolymer to the conversion coated surface.

Most preferred are fluoropolymers commercially available as ICI 302, ICI 504 and ICI 916 which are believed to be substantially similar to those disclosed in the aforementioned Yamabe et al '057 patent.

The conversion coated strip is rinsed and thoroughly dried before it is spray-coated or preferably roll-coated with a solution of the curable fluoropolymer. The thickness of the roll-coated solution is such that upon removal of solvent and curing of the fluoropolymer, it remains as a smooth uniform coating about 0.5 mil thick. A thickness of fluoropolymer less than 0.1 mil thick does not provide desirable protection; therefore a thickness in the range from about 0.1 mil to about 1.0 mil is preferred.

Preparing a Laminate of the Fluoropolymer-coated Strip and a Thermoplastic Strip In all instances where the thermoplastic strip is laminated to the surface of the fluoropolymer coating, the strip is adhesively bonded to the fluoropolymer coating, the strip is adhesively bonded to the fluoropolymer. Before the adhesive is applied, the fluoropolymer coating is subjected to a corona discharge treatment. By "corona discharge treatment" or "corona treating" refers to subjecting the surface of a solid fluoropolymer coating to a corona discharge, i.e. the ionization of a gas, typically air, in close proximity to the surface of the coating, the ionization being initiated by a high voltage passed through a proximately disposed electrode and causing oxidation and other changes to the surface of the coating. Either of two types of corona treatment may be employed. A bare electrode may be used in combination with an insulated roll, e.g. a rubber insulated roll. Alternatively, a glass electrode may be used in conjunction with a bare metal roll. Most preferred is an apparatus comprising a pair of spaced electrical conductors and a power source for supplying an alternating electrical voltage across the conductors, at least one conductor having an electrode member mounted thereto in electrical contact, the electrode member being formed from a dielectric material having a dielectric constant of at least 8 and extending towards the other conductor to define between the electrode member and the other conductor, or another electrode member extending from the other conductor, a gap in which a corona discharge can form and through which the traveling fluoropolymer-coated strip can be drawn, the conductors being sufficiently spaced apart to preclude an arc discharge between the conductors.

The minimum distance apart of the electrical conductors required to preclude an arc discharge depends of course upon the voltage applied across the conductors. For example, when the applied voltage is 6 KV the conductors should not be spaced apart by less than 20 min.

The traveling strip may be drawn through the gap by suitable drawing means which keep the strip out of contact with the electrode member and the other conductor or other electrode member. The electrode member may take the form of a plate in which an edge is directed towards the other conductor or may take the form of a series of abutting plates, e.g. ceramic plates. The dielectric material from which the electrode member is formed preferably has a dielectric constant of at least 80 and more preferably about 170. There is no specific upper limit but for practical purposes the dielectric constant should not exceed 750. The alternating voltage supplied by the power source is preferably from 6 to 20 KV at a frequency of from 2–50 Khz, more preferably from 2–30 Khz.

Referring to FIG. 1 there is shown a strip 20 of 5252 alloy about 3 mm thick and 3 cm wide and of arbitrary length, which strip is conversion coated with a complex compound coating approximately 2000Å thick having shallow peaks and valleys of a depth which is less than the thickness of the coating. The depth of valleys, the dimensions of the peaks, and the precise structures of the crystals, and therefore the density of the coating will depend upon the conditions used for producing the coating. Since there is no convenient way of measuring the density of the coating formed, suffice to state that the true density of the oxide formed is in the range from about 2.5–3.2 gm/cm$^3$.

The conversion coated strip is then coated with a fluoropolymer coating approximately 0.5 mil thick. A portion (the near portion in the Figure) of the strip 20 has a thermoplastic strip 22 adhesively bonded to it after the matrix fluoropolymer coating is treated with a corona discharge and an adhesive applied to the treated surface. No adhesive is applied to the far and near portions 24 and 26 of the strip 20 because it is to be left bare, showing the highly reflective surface of the strip.

Figure 2:
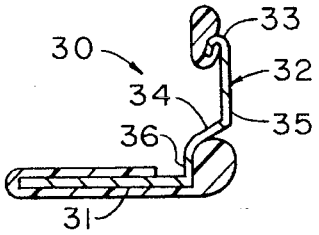
FIG. 2 is an end elevational view of another section of co-extruded aluminum strip of this invention, the upper and lower portions of which are coated with separate thermoplastic organic polymer coatings, an end of each of which is folded back upon itself over the aluminum strip, and the bright intermediate portion of the strip is left bare to exhibit its substantially mirror-like characteristics.

Referring to FIG. 2 there is shown an elevational view of another strip 30 of arbitrary length, about 20 mils thick, having a generally right-angular profile, including a laminar horizontal leg 31 1 cm long, and an arcuate vertical leg 32 about 18 mm high. Both legs are cleaned and conversion coated as described hereinbefore, then coated on both front and rear surfaces with a coating of fluoropolymer 0.5 mil thick (neither coating is visible in this drawing). The vertical leg 32 terminates in a hook 33 which is formed by bending the upper terminal portion of the leg over a mandrel having a radius of about 2 mm. The lower portion of the leg 32 is provided with a short acutely inclined portion 34 which connects the upper vertical section 35 of the leg 32 to its lower vertical portion 36, thus providing an indented lower surface of the leg 32.

Figure 3:
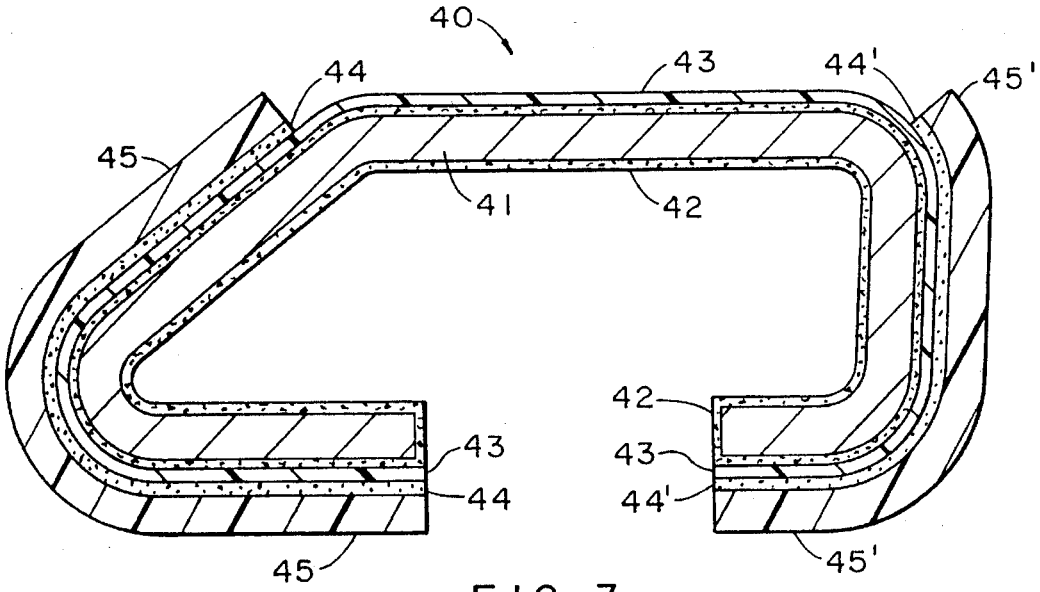
FIG. 3 is an end elevational view, greatly enlarged, to illustrate diagrammatically, the details of yet another section of co-extruded aluminum strip.

Referring to FIG. 3 there is shown a greatly enlarged view, not to scale, diagrammatically illustrating a cross-section of another co-extruded length of automotive trim identified generally by reference numeral 40. A shaped strip 41 of AA 5657 alloy about 4 cm (1.5") wide has an essentially uniformly thin aluminum conversion coating 42 generated over the entire surface of the strip. Only the outer (front) surface of the strip 41 is coated with matrix fluoropolymer 43. Since the mid-portion of the strip is to be left bright, an adhesive coating 44 and 44' is deposited over those corona-treated portions of the strip 40 to be covered with strips 45 and 45' of PVC.

In the illustrative example set forth herein, a portable corona treatment unit identified as Model PJ-2 Dual Discharge High Output Unit, manufactured by Corotec was used. The unit operates with an input of 120 volt at 5 Amps and 60 Hz frequency (single phase) and has an output of 10 KV at 0.1 Amp.

Though polymer coatings other than a matrix fluoropolymer, may benefit from a treatment with a corona discharge, it is not necessary to provide them with such treatment because their surfaces generally provide enough microscopic irregularities to permit adhesively directly bonding a strip of thermoplastic polymer, specifically a vinyl polymer, to the polymer coating, without a preliminary corona discharge treatment.

The coated reflective aluminum strip is convened to a laminate of (i) the reflective aluminum strip and (ii) a polymer strip of a suitable organic thermoplastic synthetic resinous material by cohesively bonding the strips, one to another, after at least a portion of the matrix fluoropolymer's surface is treated with an electric discharge, and by using an adhesive between the surfaces to be bonded. Though the bonding (rear) surface of the polymer strip is smooth, it has enough microscopic irregularities to be susceptible to bonding with an appropriate adhesive only if the exterior surface of the fluoropolymer is treated with the electric discharge. Such a discharge is conveniently provided by a portable unit identified hereinabove, operating at a setting of 10 Kv, 0.1 amps and 60 Hz. It will be appreciated that the precise amount of energy delivered by the corona discharge, and the conditions under which that energy is delivered, will vary depending upon the type of unit used, and the rate at which the traveling fluoropolymer-coated is to be treated. Only after being treated with the corona discharge, can the otherwise ultrasmooth exterior surface of the fluoropolymer be directly bonded to the polymer strip with an adhesive sufficiently well to be cohesively bonded.

The adhesive for the treated fluoropolymer surface is chosen specifically with respect to the particular thermoplastic polymer strip which is to form the laminate. For example, with a polyvinyl chloride strip the adhesive chosen is an acrylate-based adhesive such as B. F. Goodrich 1610 or 1617; for a polyethylene terephthalate strip the adhesive chose is an acrylate-based adhesive such as AO-420 from ITW. The adhesive coating may be applied in a thickness in the range from 0.1 to about 3 mils to ensure sufficient adhesive to provide coherent bonding of the thermoplastic strip to the fluoropolymer, though from 0.2–0.5 mil is typically sufficient. It is preferred to apply the adhesive immediately prior to applying the polymer strip under pressure. This is most preferably accomplished by co-extrusion in a commercially available roll-former such as one fitted with an extrusion die as for example in a commercial Tishken or Yoder Y-line roll-former.

Figure 4:
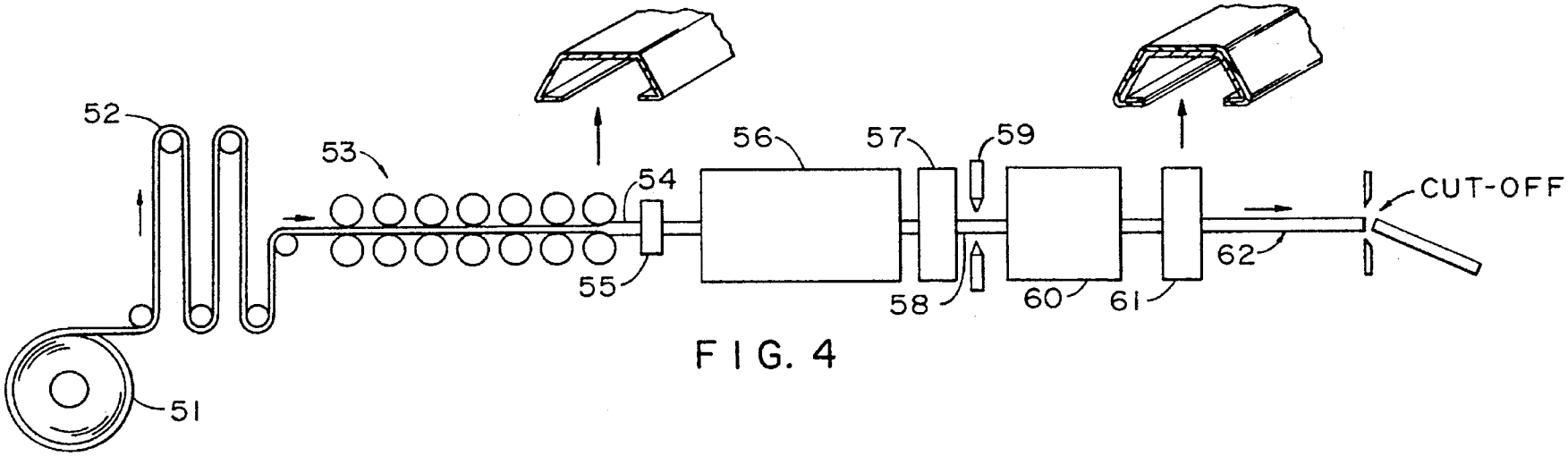
FIG. 4 is a flowsheet of a process for continuously forming co-extruded aluminum trim from fluoropolymer-coated sheet (referred to as "prefinished coil").

That portion of the process wherein the coated strip is converted to finished co-extruded trim is schematically illustrated in FIG. 4. There is shown a prefinished coil of about 4 cm wide coated aluminum alloy 51 mounted to be unwound as it is fed to an accumulator 52, then to a roll former 53 in which a plurality of rolls form the strip so that is leaves the roll former as a shaped coated strip 54 having the desired shape. The shaped strip 54 travels over a straightening block 55 mid proceeds into a cleaning solvent (typically warm water with or without detergent, because the lubricating oils used in the roll-former are water-soluble). The cleaning solvent has no effect on the inert fluoropolymer. The cleaning solvent is held in cleaning tanks 56 from which the cleaned, shaped strip 54 travels to a corona discharge station 57. Corona-discharge-treated strip 58 proceeds to adhesive applicator 59 where a film of adhesive is uniformly applied to at least those portions of the strip 58 which are to be bonded to a thermoplastic strip. The width of the thermoplastic strip is typically no greater than the width of the coated strip so that the strips may be coextensively laminated as shown in FIG. 1, but may be substantially less so as to permit reflective portions of the coated strip to be visible as shown in FIGS. 2 and 3.

The adhesive-coated strip is heated in a heating zone, preferably with an induction heater 60 and the heated strip is fed to a plastic extruder 61 in which a thermoplastic strip (not shown) is co-extruded onto the adhesive-coated strip resulting in co-extruded strip 62. The thermoplastic strip is preferably scored with a sharp knife-edge at preselected intervals corresponding to those portions of strip which are to be left substantially mirror-like. The co-extruded strip 62 is then cut-off into desired lengths and the extruded thermoplastic is peeled off the portions of the strip which are not coated with an adhesive.

As indicated, the identity of the polymeric material, not a matrix fluoropolymer, which may be adhesively bonded to the treated fluoropolymer is limited only by the choice of adhesive which will coherently bond the polymer strip to the activated fluoropolymer coating. The following are among the commercially available polymeric materials (identified by standard symbols set forth in ASTM D4000) which may be adhesively bonded to the activated fluoropolymer surface: copolymers of styrene and/or α-methyl styrene and acrylonitrile such as copolymers of styrene and acrylonitrile (SAN); terpolymers of styrene, acrylonitrile and diene rubber (ABS); copolymers of styrene and acrylonitrile modified with acrylate elastomers (ASA); copolymers of styrene and acrylonitrile modified with ethylene propylene diene monomer (EPDM) rubber (ASE); polyvinyl chloride (PVC); chlorinated polyvinyl chloride (CPVC); siloxane crosslinked to form silicone rubber; nylon (a polyamide); polycarbonate (PC); thermoplastic polyesters (TPES), including polybutylene terephthalate (PBT), polyethylene terephthalate (PET), aromatic polyester and polyether-ester segmented copolymers, such as Hytrel* by DuPont Corp.; polyurethane (PUR); and thermoplastic polyurethane (TPUR); polyphenylene oxide (PPO); polyacetals (POM); copolymer of styrene and maleic anhydride (SMA); polymers of acrylic acid, methacrylic acid, acrylic esters, and methacrylic esters; polyolefins; polyamide-imide; polyacrylonitrile; polyarylsulfone; polyester-carbonate; polyetherimide; polyether-ketone (PEK); polyether-ether-ketone (PEEK); polyphenylene sulfide; and polysulfone.

Most preferred are the co-extrudable thermoplastic polymers such as PVC, CPVC, polyolefins, particularly grafted polypropylene, TPUR, silicone rubber, PET and polysulfone.

In addition to being coherently bonded to the fluoropolymer coating, a specific polyvinyl chloride coextrudate made from pigmented Geon PVC having a specific viscosity of at least 0.20, and an intrinsic viscosity in the range from 0.95 to 1.2, exhibits exceptional physical properties as evidenced by the tests specified below in Tables 3 and 4.

The co-extruded strip is subjected to numerous tests to determine whether it will be a suitable substitute for bright stainless steel or bi-metal. Among such tests are ones used for accelerated exposure testing, and others used for natural outdoor exposure testing. Such tests which together provide evidence for substitutability are listed herebelow in Tables 2 and 3. The PVC-coextruded strip of this invention passes all the tests identified with the appropriate test number, and succinctly described herebelow.

TABLE 2—ACCELERATED EXPOSURE TESTING

Test identif: Test Specifications $H_2S$ resistance: HCl and $K_2S$ reactants for 10 sec (GM9060P)

$SO_2$ resistance: $Na_2SO_4$ and $H_2SO_4$ reactants for 25 min (GM 9736P)

Naptha resistance: 1 hr immersion in aliphatic naphtha @24° C.

Detergent resistance: 24 hr immersion in Calgon Triple C detergent @ 24° C. (ASTM D2248)

Gasoline resistance: 3 hr immersion for 5 consecutive days (GM 9531P)

High Pressure Car Wash: 10 sec water spray at 45° angle, 8" distance from scribed and unscribed surface (GM 9531P)

High Pressure Air: Air blast @ 173 to 206 kPa (25–30 psig)

Cleveland Condensing Humidity: 1000 hr @ 38° C. and 100% humidity (ASTM 2247)

Carbon Arc Weather-O-Meter: 1600 hr (ASTM G23)

Fluorescent UV and Condensation (QUV): Cycle of 4 hr condensing humidity @ 50° C. and 8 hr fluorescent UV (8 bulbs) at 70° C.—2500 hr total (SAE J2020)

Oven Aging: 7 days @ 70° C., 3 days condensing humidity @ 38° C., knife cross-hatch adhesion (GM 9504)

High Temperature: (1) 2 weeks @ 88° C.; (2) 30 min @ 121° C.

Water Immersion: 240 hr in 32° C. DI water (ASTM D870)

Salt Spray: 1000 hr of exposure to continuous 5% salt spray @ 49° C. (ASTM B117)

Thermal Shock: (1) 3 hr in 38° C. water, 3 hr in –29° C. freezer, scribing and direct steam blast (FLTM BI 7-3); (2) 4 hr in 32° C. water, 3 hr in –29° C. freezer, scribing and direct steam blast (GM 9525P)

Room Temperature Impact: 1.1 Joules (10 inch pounds) with 13 mm impact head

Low Temperature Impact: 0.57 Joules (5 inch pounds) with 13 mm impact head

Gold Checking Cycle: 10 cycles–16 hr condensing humidity @ 38° C.; 4 hr @—30° C.; 2 hr @ 24° C.; 2 hr @ 65° C. (FLTM BI 107-02)

Scratch Test: Knife @ 30° angle, cut to base metal (FLTM BI 106-01)

Scribe Test: Cross-hatch cuts to base metal plus tape pull with #610 high-tack ScotchR tape (FLTM BI 106-01)

Chip Resistance: 550 ml gravel @ 480±20 kPa (70 psi) (ASTM D3170; SAE J4000 Gravelomelet)

Gravelometer with Salt Spray: SAE J400 Gravelometer plus 48 hr ASTM B117 Salt Spray In the following outdoor tests, as in the foregoing tests of Table 2, a statistically significant number of co-extruded strips of this invention were tested by being left outdoors for the time indicated. Data on other strips coated with matrix fluoropolymer are those obtained by others on bare aluminum, that is, having a naturally occurring oxide film because the aluminum strips were not given a specified anodizing treatment.

Having thus provided a general discussion, described the coated strip and co-extruded trim as well as the overall process for producing each article, and having illustrated the invention with specific examples of the best mode of making the articles and carrying out the process, it will be evident that the invention has provided an effective solution to a difficult problem. A fluoropolymer coating such as is used in U.S. Pat. No. 5,035,940, is interstitially mechanically bonded to an aluminum conversion coating on a mirror-like strip of aluminum without using an adhesive and substantially without sacrificing the D/I of the surface. The fluoropolymer is not debonded by sharply bending the strip which is thus doubly-protected against deterioration of its surface for at least one year. The ultra-smooth surface of such a strip requires corona treatment to bond an adhesive, mainly mechanically to the fluoropolymer surface, but the adhesive adhesively secures a thermoplastic strip to form a laminate. No undue restrictions are to be imposed by reason of the specific embodiments illustrated and discussed, except as provided by the following claims.

We claim:

1. A process for coating at least one surface of an aluminum alloy sheet with a conversion coating and a fluoropolymer coating, said process comprising, providing a bright rolled aluminum alloy sheet having at least 85% D/I and 2° diffuseness less than 1.00;

chrome conversion coating a cleaned surface of said aluminum alloy sheet to generate on said surface a tightly adherent film of a metal compound in the range of from 3 to 20 mg/ft$^2$ and a thickness less than about 4000Å in a conversion coating bath at a temperature in the range from about 60° F. to 100° F.;

rinsing said conversion coated surface and drying, to leave a dry reflective surface; and contacting said dry reflective surface with a fluoropolymer and curing said fluoropolymer to bond the fluoropolymer to said surface, so as to form sheet coated with a conversion coating and fluoropolymer on at least one surface which maintains at least 80% D/I and which is suitable to being shaped into a profile having at least one radius which is less than 10 mm without debonding said cured fluoropolymer from said conversion coating.

2. The process of claim 1 wherein said fluoropolymer is thermally cured.

3. The process of claim 2 wherein said fluoropolymer is a thermally curable fluorocopolymer comprising 40 to 60 mol % of fluoroolefin units, 5 to 45 mol % of alkyl vinyl ether units and 3 to 15 mol % of hydroxyalkyl vinyl ether units, said polymer having an inherent viscosity of 0.05 to 2.0 dl/g in tetrahydrofuran at 30° C.

4. The process of claim 1 which includes shaping the fluoropolymer coated aluminum alloy sheet to form a profile having at least one radius which is less than 10 mm.

5. The process of claim 1 which includes, treating a selected portion of said of the surface of said cured fluoropolymer with a corona discharge; and adhesively bonding a thermoplastic strip to the corona discharge treated surface of said sheet.

6. A process for converting a sheet of aluminum alloy in the range from about 0.010" (inch) (0.25 mm) to about 0.050" (1.25 mm) thick, into a decorative reflective sheet, protected with a combination of a conversion coating and cured fluoropolymer coating, said protected sheet having a surface substantially free of degradation due to environmental exposure, said process comprising:

(a) providing a bright rolled aluminum alloy sheet having a D/I of at least 85% and a 2° diffuseness no greater than 1.00;

(b) cleaning at least one surface of said sheet of aluminum alloy to remove superficial contaminants and leave a clean surface;

(c) chrome conversion coating said clean surface in a conversion coating both in a temperature range of from 60° F. to 100° F. to generate said clean surface a tightly adherent film of a metal compound in the range of from 3 to 20 mg/ft$^2$ and a thickness less than about 4000Å;

(d) rinsing said conversion coated surface and drying, to leave a dry reflective surface;

(e) contacting said dry reflective surface with a fluoropolymer in an amount such that, upon curing, a cured fluoropolymer is interstitially mechanically bonded to said conversion coating, so as to form said reflective sheet coated on at least one side which maintains at least 80% D/I; and (f) shaping said coated sheet to conform to a profile having at least one radius which is less than 10 mm without debonding said cured matrix fluoropolymer from said conversion coating at the interface thereof.

7. In a process for making a decorative laminate of shaped reflective aluminum strip having a D/I of at least 80% which strip is protected first with a conversion coating, then with a coating of organic polymer, and followed with a coating consisting essentially of an organic thermoplastic synthetic resinous strip adhesively laminated to said organic polymer, the improvement comprising, (a) generating on a surface of said reflective strip, a chrome conversion coating in a density range of from 3 to 20 mg/ft$^2$ and a thickness less than about 4000Å;

(b) rinsing said conversion coated surface in water and drying, (c) contacting said conversion coated surface with a dilute solution of a light-permeable fluoropolymer in an inert organic solvent, said fluoropolymer being present in an amount such that, upon curing, a cured matrix fluoropolymer is interstitially mechanically bonded to said conversion coating, without substantially sacrificing the reflected image clarity and other optical properties of said reflective surface of said aluminum alloy having a D/I of at least 80%, (d) shaping said dual-coated strip to conform to a profile having at least one radius which is less than 10 mm without debonding said cured matrix fluoropolymer from the conversion coating at their interface, (e) treating a selected portion in the range from 0 to 100% of said fluoropolymer's exterior surface, with a corona discharge sufficiently to produce an activated fluoropolymer surface able to interstitially non-adhesively bond an organic adhesive, to which adhesive, in turn, said strip of thermoplastic polymer is adhesively bondable, (f) coating said selected portion of said activated surface with said organic adhesive while maintaining the remaining portion bare and reflective, and (g) contacting said organic thermoplastic synthetic resinous strip with said organic adhesive under sufficient pressure to form a coherent bond between said thermoplastic strip and said fluoropolymer coating, whereby said bare and reflective portion of said fluoropolymer's surface has a D/I which is essentially undiminished, and said strip retains substantially mirror-like characteristics after being subjected to degradation due to prolonged environmental exposure.

8. The process of claim 7 wherein said bath is at a temperature in the range from 25° C. to 50° C.; and, said matrix fluoropolymer coating remains bonded to said conversion coating after said strip is bent in a Half-T Bend ASTM D-3794-79 test.

* * * * *